US007467794B2

(12) United States Patent
Kubota et al.

(10) Patent No.: US 7,467,794 B2
(45) Date of Patent: Dec. 23, 2008

(54) SHEET CONVEYANCE PROBLEM RELEASE MECHANISM AND SHEET STACKING APPARATUS

(75) Inventors: Ichitaro Kubota, Kofu (JP); Daisuke Kaneoya, Yamanashi-ken (JP); Kunihide Suzuki, Kofu (JP)

(73) Assignee: NISCA Corporation, Minamikoma-Gun, Yamanashi (JP)

( * ) Notice: Subject to any disclaimer, the term of this patent is extended or adjusted under 35 U.S.C. 154(b) by 52 days.

(21) Appl. No.: 11/411,036

(22) Filed: Apr. 26, 2006

(65) Prior Publication Data

US 2006/0244209 A1 Nov. 2, 2006

(30) Foreign Application Priority Data

Apr. 27, 2005 (JP) ..... 2005-129168

(51) Int. Cl.
*B65H 39/10* (2006.01)

(52) U.S. Cl. ..... 271/303; 271/225; 271/288

(58) Field of Classification Search ..... 271/279, 271/225, 303, 287, 288, 289; 399/111
See application file for complete search history.

(56) References Cited

U.S. PATENT DOCUMENTS

| | | | | | |
|---|---|---|---|---|---|
| 3,661,383 | A * | 5/1972 | Morrison | 271/273 |
| 4,787,616 | A * | 11/1988 | Sasaki et al. | 271/3.03 |
| 4,954,847 | A * | 9/1990 | Murata et al. | 399/374 |
| 5,064,188 | A * | 11/1991 | Nagao et al. | 271/301 |
| 5,154,411 | A * | 10/1992 | Saito et al. | 271/289 |
| 5,456,456 | A * | 10/1995 | Abe et al. | 271/10.09 |
| 5,961,110 | A * | 10/1999 | Adachi et al. | 270/58.01 |
| 6,112,047 | A * | 8/2000 | Kato et al. | 399/381 |
| 6,331,003 | B1 * | 12/2001 | Yokota et al. | 271/290 |
| 6,886,828 | B2 * | 5/2005 | Saito | 271/225 |
| 7,222,955 | B2 * | 5/2007 | Ohashi et al. | 347/104 |
| 2002/0070496 | A1 * | 6/2002 | Ito et al. | 271/177 |

FOREIGN PATENT DOCUMENTS

| | | | |
|---|---|---|---|
| JP | 63272751 | A * | 11/1988 |
| JP | 02-193864 | | 7/1990 |
| JP | 02193864 | A * | 7/1990 |
| JP | 02255461 | A * | 10/1990 |
| JP | 05058539 | A * | 3/1993 |
| JP | 10-35994 | | 2/1998 |
| JP | 2001-121783 | | 5/2001 |

* cited by examiner

*Primary Examiner*—Patrick H Mackey
*Assistant Examiner*—Gerald W McClain
(74) *Attorney, Agent, or Firm*—Manabu Kanesaka

(57) ABSTRACT

A sheet conveyance release mechanism has a movable guide unit and a fixed guide unit adjacent to the movable guide unit. The mechanism has a horizontal conveyance guide unit for conveying a sheet in a substantially horizontal direction, and a vertical conveyance guide unit for conveying a sheet in a substantially vertical direction. A jam release lever moves the movable guide unit from a first position adjacent to the fixed guide unit in the horizontal direction to a second position below the fixed guide unit, and moves the vertical conveyance guide unit so as to separate from a guide surface.

8 Claims, 9 Drawing Sheets

SHEET CONVEYANCE PROBLEM RELEASE MECHANISM AND SHEET STACKING APPARATUS

BACKGROUND OF THE INVENTION AND RELATED ART STATEMENT

The present invention relates to a sheet conveyance problem release mechanism and sheet stacking apparatus, and more particularly to a sheet conveyance problem release mechanism of a device having a conveyance guide for conveying sheets, and a sheet stacking apparatus provided with the same.

Conventionally, sorters that sequentially sort sheets, having discharge trays or a plurality of bins for sequentially stacking sheets formed with characters and/or images by an image forming apparatus such as a copier or printer, a sheet discharge apparatus or sheet stacking apparatus, such as a mailbox that separates and stores user print jobs to each bin, are well known in the art. These apparatuses are generally provided with a jam handing mechanism to handle sheet conveyance problems.

For such jam handing mechanisms, Japanese Patent Publication No. Hei 10-35994 discloses a mechanism that separates a frame into a plurality of frames for sliding to move a moving frame on a fixed frame. Japanese Patent Publication No. Hei 2-193864 discloses a mechanism that rotates an opening door. Furthermore, Japanese Patent Publication No. Tokkai 2001-121783 discloses a mechanism that rotates a discharge cover that is integrally formed to a stacking unit that stacks discharged sheets.

However, with the technology disclosed in Publication No. Hei 10-35994, mentioned above, plenty of extra space to allow the sliding movement of the moving frame is necessary to handle jammed sheet. There is much labor involved in the sliding movement of the moving frame. With the technology disclosed in Publication No. Hei 2-193864, plenty of extra space is necessary at the device side area, along with the rotation to the machine side of the opening door, to open the inside of the device. Furthermore, with the technology disclosed in Publication No. 2001-121783, plenty of extra space is required above the device for rotating the sheet discharge cover to the outside of the device to open the inside of the device. Because the sheet discharge cover is lifted upward, the ease of handling jammed sheets became an issue.

An object of the present invention, therefore, is to provide a sheet conveyance problem handing mechanism that makes the handling of sheet jams simple, without employing a mechanism that requires extra space or excessive labor to handle jams.

Another object of the present invention is to provide a sheet stacking apparatus that makes the handling of sheet jams simple, without employing a mechanism that requires extra space or excessive labor to handle jams.

SUMMARY OF THE INVENTION

In order to attain the aforementioned objects, a first aspect of the present invention is a sheet conveyance problem release mechanism of a device having a conveyance guide for guiding a sheet. The mechanism includes a movable guide unit; a horizontal conveyance guide unit for conveying a sheet substantially horizontally, having a fixed guide unit provided adjacent to movable guide unit; a vertical conveyance guide unit for conveying a sheet substantially vertically; and conveyance guide moving means for moving the movable guide unit from a first position adjacent to the fixed guide unit in a horizontal direction to overlap the fixed guide unit at a second position either under or over the fixed guide unit, and for moving the vertical conveyance guide unit to separate from an opposingly arranged guide surface.

According to the first aspect, in a normal state, a sheet is conveyed by being guided to a horizontal conveyance guide unit to be conveyed substantially horizontally, or a vertical conveyance guide unit to be conveyed substantially vertically. In this state, the movable guide unit is positioned at a first position adjacent to the fixed guide unit in a horizontal direction. In the event that a sheet conveyance problem occurs at the horizontal conveyance guide or the vertical conveyance guide, an operator can operate conveyance guide movement means and use the space inside the apparatus to move the movable guide unit from the first position to a second position that is either above or below the fixed guide unit to overlap the fixed guide unit, and move the vertical conveyance guide unit to separate from an opposingly arranged guide surface. Normally, the space of the movable guide unit that was positioned at the first position is freed, and the space between the vertical conveyance guide unit and the guide surface is widened, so the operator can access the inside of the apparatus from above and easily handle the jammed sheet, without the system requiring extra space or excessive labor in handling a jam caused by a sheet conveyance problem.

According to the first aspect of the present invention, in order to make the conveyance guide compact, the movable guide unit that configures a portion of the horizontal conveyance guide unit and the vertical conveyance guide unit are integrally formed. Still further, it is acceptable to provide flappers for switching a conveyance path for a sheet conveyed between the horizontal conveyance guide unit and the vertical conveyance guide unit, and a link member that rotates the flappers in an upward direction. The link member can provide support so that a predetermined gear of a plurality of gears that transmit drive for conveying sheets can be separated from another gear that is opposingly arranged and meshed thereto. In a drive transmission path leading to a sheet discharge unit for discharging a sheet to outside of the apparatus, the predetermined gear established at an upstream side of the drive transmission path from the gears that provide direct drive to the sheet discharge unit is configured to be separated via the link member to cut the drive transmission at an upstream side of the drive transmission path.

Conveyance guide movement means include a rotatable lever member connected to the moving guide unit and a vertical conveyance guide unit. Along with the rotating action of this lever member, the vertical conveyance guide unit rotates to an angle along with the rotation and movement of the movable guide unit to under the fixed guide unit. A portion of the lever member engages the link member to move the link member which separates the predetermined gear from the other gear, thereby interrupting drive transmission. Also, the link member rotates a rotating shaft of the flappers causing the flappers to rotate to an upward direction.

Also, in order to attain the aforementioned objects, a second aspect of the present invention includes a movable guide unit and a fixed guide unit arranged adjacent to the movable guide unit, formed on a sheet conveyance path, in a sheet stacking apparatus having a plurality of discharge trays for stacking sheets discharged from a sheet discharge outlet arranged in up and down directions. The invention provides a horizontal conveyance guide unit for conveying sheets in a substantially horizontal direction; a vertical conveyance guide unit for conveying sheets in a substantially vertical direction; flappers for switching a sheet conveyance path of sheets conveyed between the movable guide unit and the fixed guide unit; and conveyance guide movement means that moves the movable guide unit from a first position adjacent the fixed guide unit in a horizontal direction, to a second position that is either above or below the fixed guide unit to overlap with the fixed guide unit, and that moves the vertical conveyance guide unit to separate from an opposingly arranged guide surface.

According to the second aspect, in normal conveyance, the flappers switch the conveyance path between the horizontal conveyance guide unit for conveying a sheet substantially horizontally, and a vertical conveyance guide unit for conveying a sheet substantially vertically so a sheet is conveyed by guiding it to either the horizontal conveyance guide unit or the vertical conveyance guide unit. The sheet is discharged via a sheet discharge unit and stacked in any of the plurality of trays. In this state, the movable guide unit is positioned at a first position adjacent to the fixed guide unit in a horizontal direction. In the event that a sheet conveyance problem occurs at the horizontal conveyance guide or the vertical conveyance guide, an operator can operate conveyance guide movement means and use the space inside the apparatus to move movable guide unit from the first position to a second position that is either above or below the fixed guide unit to overlap the fixed guide unit, and move the vertical conveyance guide unit to separate from an opposingly arranged guide surface. Normally, the space of the movable guide unit that was positioned at the first position is freed, and the space between the vertical conveyance guide unit and the guide surface is widened, so the operator can access the inside of the apparatus from above and easily handle the jammed sheet, without the system requiring extra space or excessive labor in handling a jam caused by a sheet conveyance problem.

According to the second aspect of the present invention, it is acceptable for the movable guide unit that configures a portion of the horizontal conveyance guide unit and the vertical conveyance guide unit to be integrally formed to connect the guide surface for conveying sheets. The flappers have a rotating shaft and are configured to rotate around that rotating shaft. A link member is also provided to rotate the rotating shaft of the flappers to rotate the flappers in an upward direction. A drive transmission unit having a plurality of linked gears is provided to convey and to transmit drive force to discharge sheets to a tray. The link member can provide support so that a predetermined gear of a plurality of gears that transmit drive for conveying sheets can be separated from another gear that is opposingly arranged and meshed thereto. In a drive transmission path leading to a sheet discharge unit for discharging a sheet to outside of the apparatus, the predetermined gear established at an upstream side of the drive transmission path from the gears that provide direct drive to the sheet discharge unit is configured to be separated via the link member to cut the drive transmission at an upstream side of the drive transmission path.

Conveyance guide movement means include a rotatable lever member connected to the moving guide unit and a vertical conveyance guide unit. Along with the rotating action of this lever member, the vertical conveyance guide unit rotates to an angle along with the rotation and movement of the movable guide unit to under the fixed guide unit. A portion of the lever member engages the link member to move the link member which separates the predetermined gear from the other gear thereby interrupting drive transmission. Also, the link member rotates a rotating shaft of the flappers causing the flappers to rotate to an upward direction.

These and other objects will become more apparent when a preferred embodiment of the invention is described in connection with the accompanying drawings.

BRIEF DESCRIPTION OF THE DRAWINGS

FIGS. 8A, 8B, 8C and 8D show the operation of a sensor lever to explain the sheet detection operation using a sensor of the sheet stacking apparatus, wherein FIG. 8A shows the sensor lever in an idle state prior to sheet discharge; FIG. 8B shows a leading edge of a sheet beginning to be discharged pushing the sensor lever in an upward direction; FIG. 8C shows the sensor lever as the discharging sheet advances further; FIG. 8D shows the sensor lever raised to its uppermost position as the discharging sheet advances further.

DETAILED DESCRIPTION OF THE PREFERRED EMBODIMENTS

Preferred embodiments of the sheet stacking apparatus according to the present invention are described below with reference to the accompanying drawings.

Figure 1:
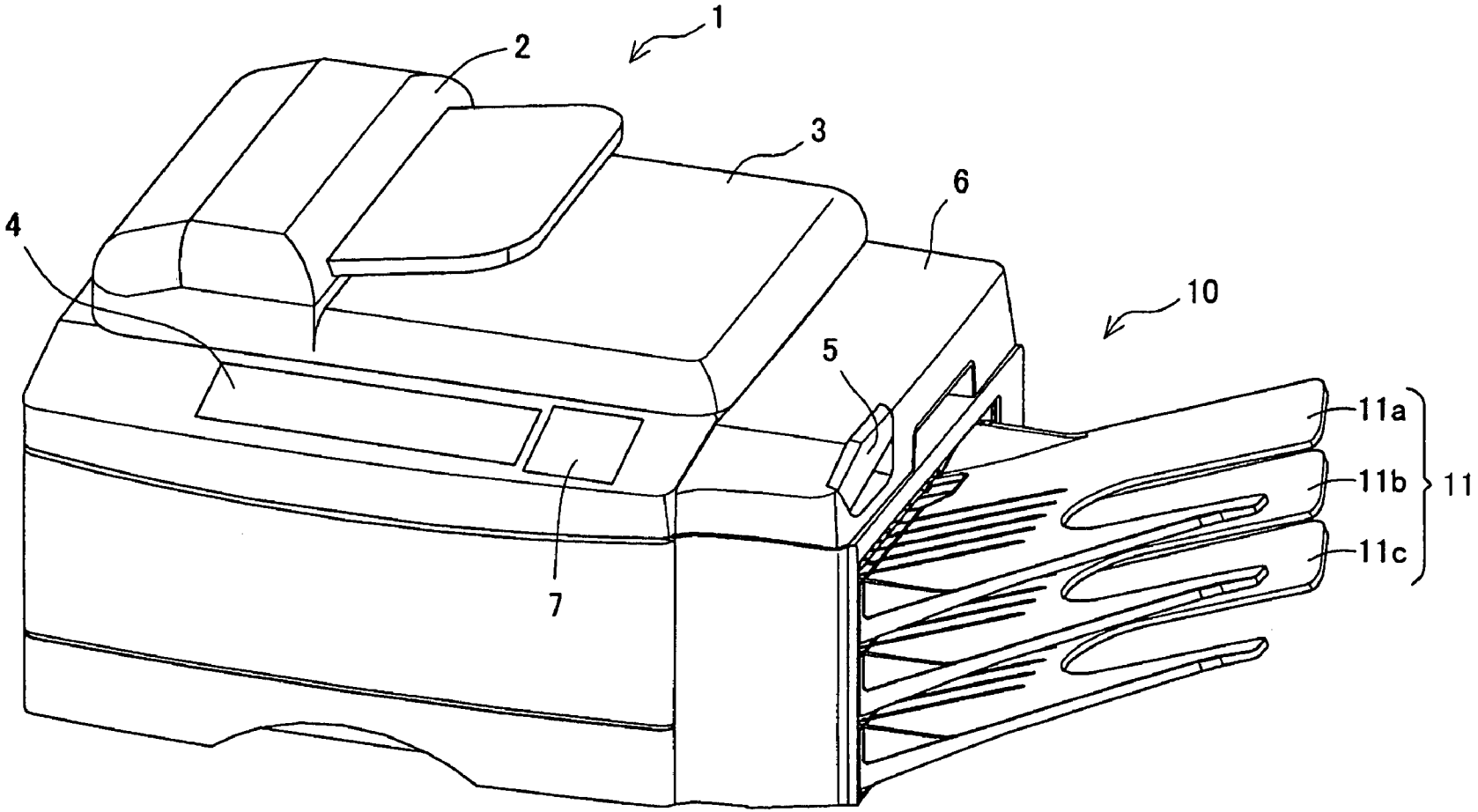
FIG. 1 is an external, perspective view of a sheet stacking apparatus that can apply the present invention, installed in an image forming apparatus.

As shown in FIG. 1, the sheet stacking apparatus 10 of the present invention is mounted to a side of an image forming apparatus 1 having faxing, copying, scanning and/or printer functions as the main unit.

The image forming apparatus 1 has an automatic document feeder unit (commonly known as an ADF) 2 for automatically conveying originals, on a top portion of the apparatus. An image reading unit, not shown, for reading originals is arranged below the automatic document feeder 2. For that reason, the image reading unit can read originals using either of two methods. Specifically, this unit can read characters and images formed on an original while the original is conveyed by the automatic document feeder 2, or it can read characters and images formed on the original placed in a stationary position on a platen, not shown. The cover, such as a pressure plate 3, over the platen can be opened in an upward direction to allow the original to be placed stationary on the platen.

A display unit 4 for displaying processes of the image forming apparatus 1, and a UI panel 7 for issuing operating instructions to the image forming apparatus 1 are arranged on the front side (the near side of FIG. 1) of the image forming apparatus 1. A lock lever 5 that opens the inside of the image forming apparatus 1 is arranged on the top portion of the sheet stacking apparatus 10 side of a top cover 6.

The image forming apparatus 1 has an interface that connects to a PC via a printer cable or network cable, not shown. This image forming apparatus 1 is used as a multi-functional device having a printing function for printing characters and images generated on the PC, a faxing function for sending and receiving character and image data read by an image reading unit connected to a telephone/communication line, and copying and scanning functions that can be used independent of a PC. Note that an operator can use the UI panel 7 to set the image forming apparatus 1 to use its printer, facsimile, scanner or copier functions. The operator can output sheets by providing instructions to the image forming apparatus 1 from a host PC via a printer cable or network cable.

The sheet stacking apparatus 10 has trays 11*a*, 11*b*, and 11*c* for stacking sheets discharged from the image forming apparatus 1, arranged in up and down directions. Each tray is arranged at a slant of a predetermined angle. Note that these trays 11*a*, 11*b*, and 11*c* have a configuration allowing them to be detachably mounted to the sheet stacking apparatus 10, as described in detail below.

It is possible to operate the UI panel 7 or provide instructions via the host PC to select either the discharge tray 11*a*, 11*b*, or 11*c* as the destination tray (for stacking) of sheets discharged from the image forming apparatus 1, depending on the way the image forming apparatus 1 is used. For example, if sheets are printed, they can be stacked on the discharge tray 11*a*. The discharge tray 11*b* can be used for stacking facsimiles, and the discharge tray 11*c* can be used for stacking copies. In addition, these trays can be used as mail bin sorters (in a mailbox system) by sorting sheets differentiating each tray to use for each user by selecting the tray that corresponds to the user's needs. Of course, if the desired tray is full of stacked sheets, the user can switch subsequent sheets to be discharged and stacked in a different tray.

The lock lever 5 is configured to be released when there has been a conveyance problem of a sheet formed with an image, in the image forming apparatus 1 or the sheet stacking apparatus 10, to solve the problem (by removing a so-called paper jam) by rotating the upper cover 6 along with the automatic document feeder 2, the pressure plate 3, the display unit 4, the UI panel 7, and the image reading unit mentioned above, upward and away from the sheet stacking apparatus 10, thereby exposing the inside of the apparatus, not shown.

A sheet formed with characters and images by the image forming apparatus 1 is discharged to a tray 11 (11*a*, 11*b*, or 11*c*) of the sheet stacking apparatus 10 by being conveyed through a predetermined conveyance path. However, as shown in FIGS. 2 to 5, a sheet conveyance problem release mechanism 60 is provided on the sheet stacking apparatus 10 of the present invention as a mechanism for releasing jammed sheets (a sheet conveyance problem). This sheet conveyance problem release mechanism 60 is used when a problem that a sheet is not discharged to the proper tray 11 because a sheet conveyance problem, such as a so-called sheet jam, has occurred in the sheet conveyance path leading to the sheet discharge outlet leading to the tray 11. Specifically, in the event that a jam occurs, an operator operates a jam release lever 61 as a part of conveyance guide movement means and a lever member, provided in an erect manner to a side of the main unit. This makes it possible to remove a sheet remaining in the conveyance path that is experiencing the conveyance problem.

FIGS. 2 to 5 show the upper cover 6 of the image forming apparatus 1 in an opened (rotated upward) state. A guide unit (not shown) that composes a portion of the sheet conveyance path of the sheet stacking apparatus 10, having a substantially horizontal guide surface opposingly arranged to a substantially horizontal conveyance guide unit (a bottom guide unit) including a fixed guide and a moving guide is mounted to the upper cover 6 side of the image forming apparatus 1. Therefore, when the upper cover 6 of the image forming apparatus 1 is opened, a portion (specifically, the horizontal conveyance guide unit) of the inside of the sheet stacking apparatus 10 is exposed. Also shown in FIGS. 2 to 5, a portion of an external cover of the sheet stacking apparatus 10 is removed to make it possible to check the inner configuration of the sheet stacking apparatus 10. (Also see FIG. 1.)

Figure 2:
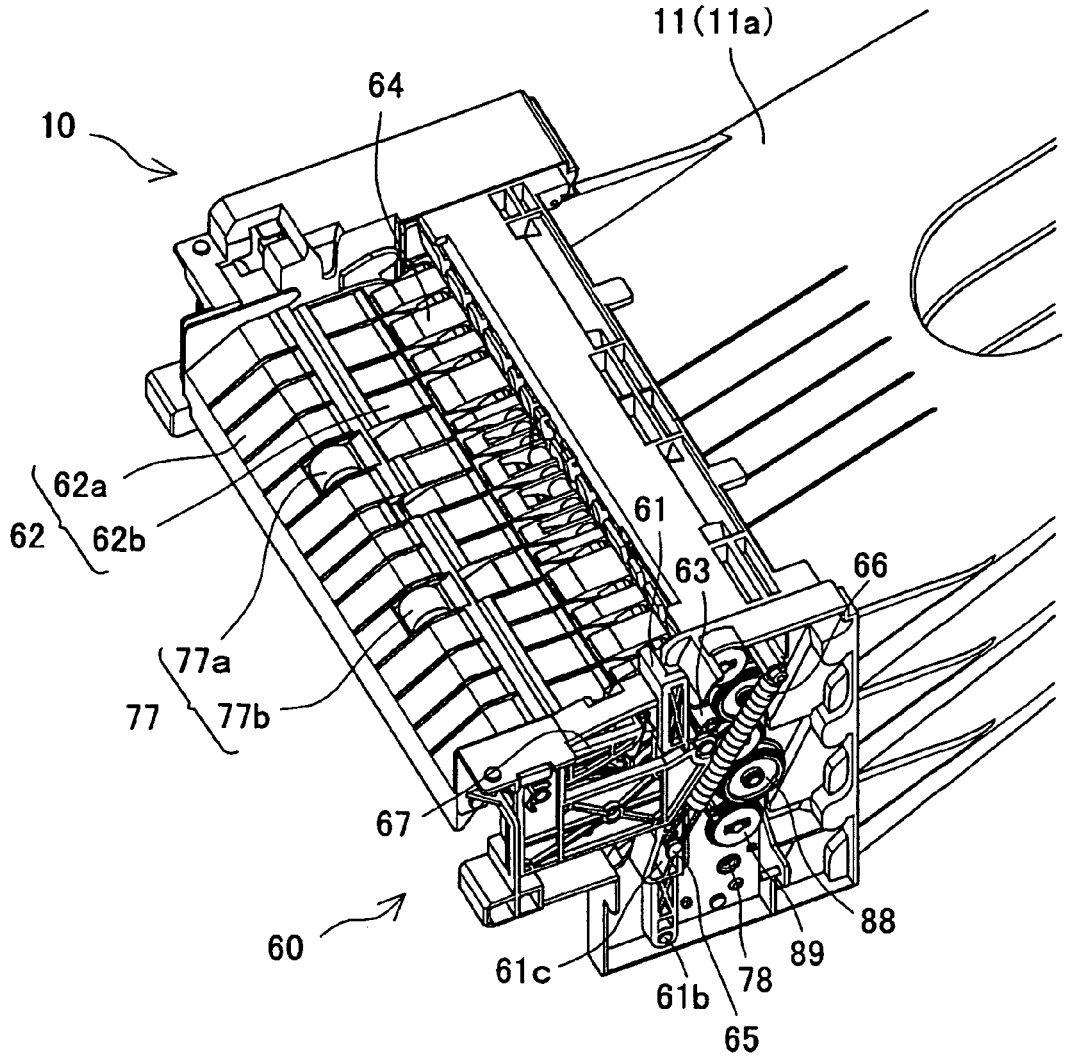
FIG. 2 is an external perspective view of a sheet stacking apparatus with a portion of an external cover removed showing the jam release lever not operated.

As shown in FIG. 2, the sheet stacking apparatus 10 has a horizontal conveyance guide unit 62 for conveying a sheet handed over from the image forming apparatus 1 substantially horizontally therebetween the horizontal guide unit (not shown), mentioned above. The horizontal conveyance guide unit 62 includes a fixed guide unit 62*a* provided adjacent to the image forming apparatus 1, and movable guide unit 62*b* provided adjacent to the fixed guide unit 62*a* at a downstream side in a direction of sheet conveyance of the fixed guide unit 62*a*. Inlet rollers 77 (77*a* and 77*b*) that have drive force are arranged to convey a sheet handed over from the image forming apparatus 1 to discharge rollers 21 (21*a* and 21*b*; see FIG. 6), described in detail below. Flappers 64 that switch conveyance paths of conveyed sheets are rotatably established having a rotating shaft 63, at a downstream side in a direction of sheet conveyance of the movable guide unit 62*b*. In the state shown in FIG. 2 (also see FIG. 4), the flappers 64 maintain a horizontal state. A sheet is conveyed along a top surface of the flappers 64 and is discharged to the uppermost tray 11*a*. Note that when the flappers 64 are maintained at a horizontal state, the flappers 64 also compose a portion of the horizontal conveyance path.

Figure 3:
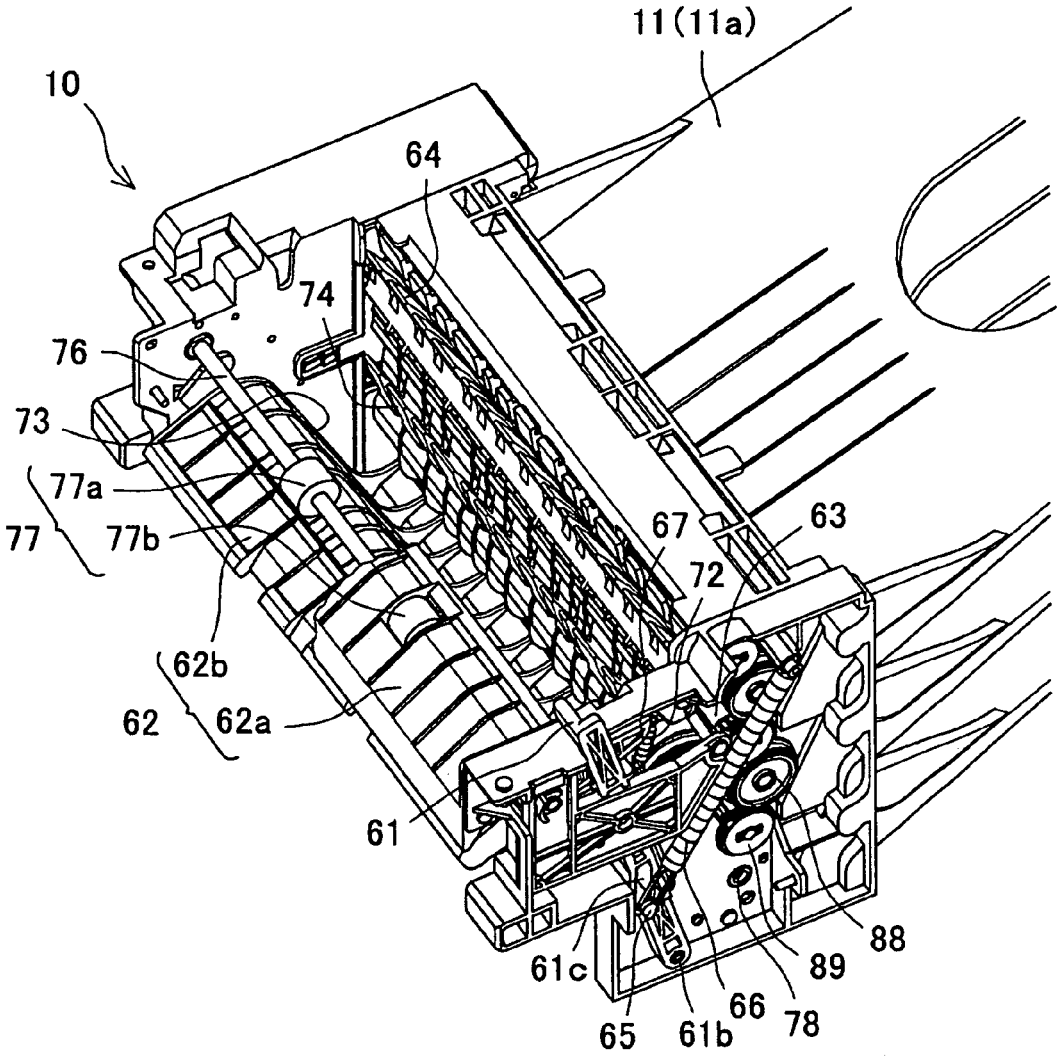
FIG. 3 is a partially cut-away, external perspective view of the sheet stacking apparatus with a portion of the external cover removed showing the jam release lever operated.
Figure 4:
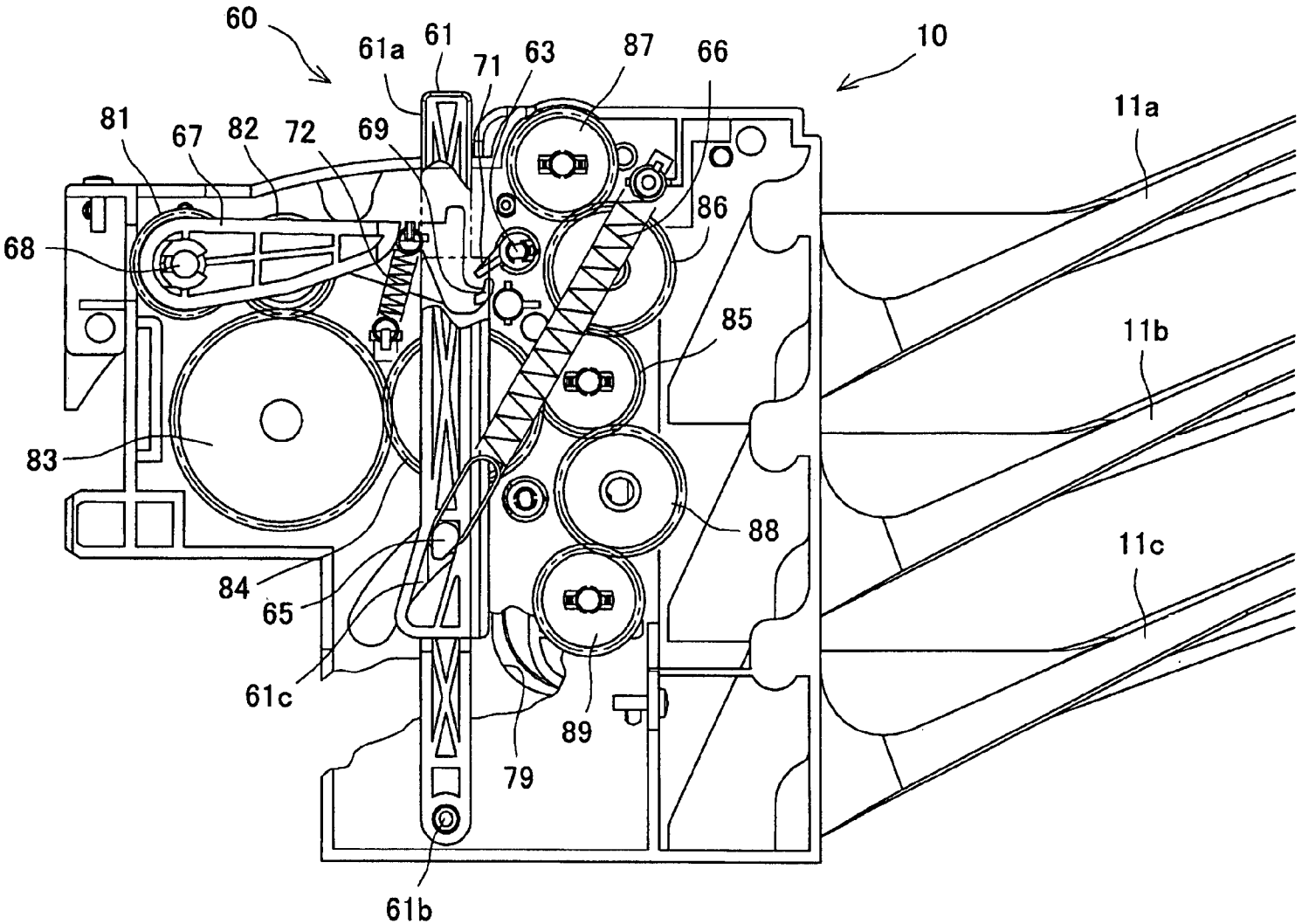
FIG. 4 is a partially cut-away, front view of the sheet stacking apparatus of the state shown in FIG. 2.
Figure 9:
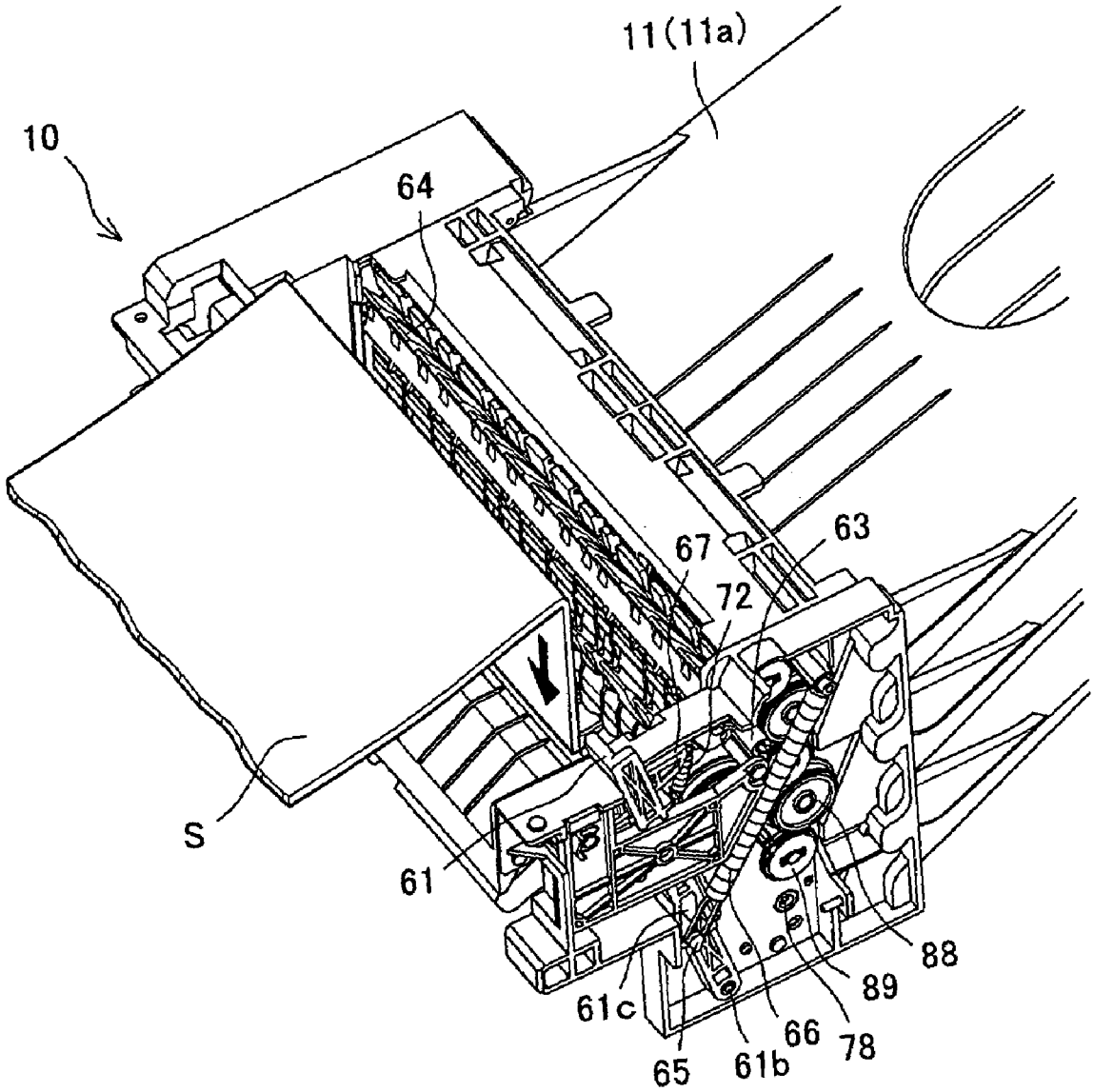
FIG. 9 is an explanatory perspective view, similar to FIG. 2, showing a sheet being transferred horizontally and vertically.

As shown in FIGS. 2 and 3, the flappers 64 rotate in an upward direction around the rotating shaft 63 by the action of a solenoid and actuator, not shown. This has the function of switching the sheet conveyance path to guide a discharging sheet into the trays 11*b* or 11*c*, positioned below. Specifically, by the flappers 64 switching the conveyance path, a sheet is discharged from the fixed guide unit 62*a* and the movable guide unit 62*b* of the horizontal conveyance guide unit 62 that forms a horizontal conveyance path, to the tray 11*b* or 11*c* after being fed into the vertical conveyance path formed between the vertical conveyance guide unit 73 that connects from the top surface of the movable guide unit 62*b*, and a guide surface that is opposingly arranged to the guided conveyance guide unit 73. Namely, the sheet S is guided horizontally along the horizontal conveyance path and then vertically along the vertical conveyance path, as shown in FIG. 9. Note that with this embodiment, a different surface of the vertical conveyance guide unit 73 that is formed as a portion (integrally formed to the movable guide unit 62*b*) of the same member as the movable guide unit 62*b* is used. This is normally positioned substantially vertically.

As shown in FIGS. 2 to 5, the jam release lever 61 includes an operating portion 61*a* at the top of the lever that is accessed by an operator for removing jammed sheets, and a rotating pivot point 61*b* at the bottom of the lever. The jam release lever 61 rotates in the direction of the arrow X in FIG. 5 around this rotating pivot point 61*b*. A long hole 61*c* is formed at a position leading slightly downward at the middle. A protrusion 65 provided at a predetermined position on a side of the guide member having the movable guide unit 62*b* and vertical conveyance guide unit 73, is inserted into the long hole 61*c*. The jam release lever 61 and the guide member are connected.

Figure 5:
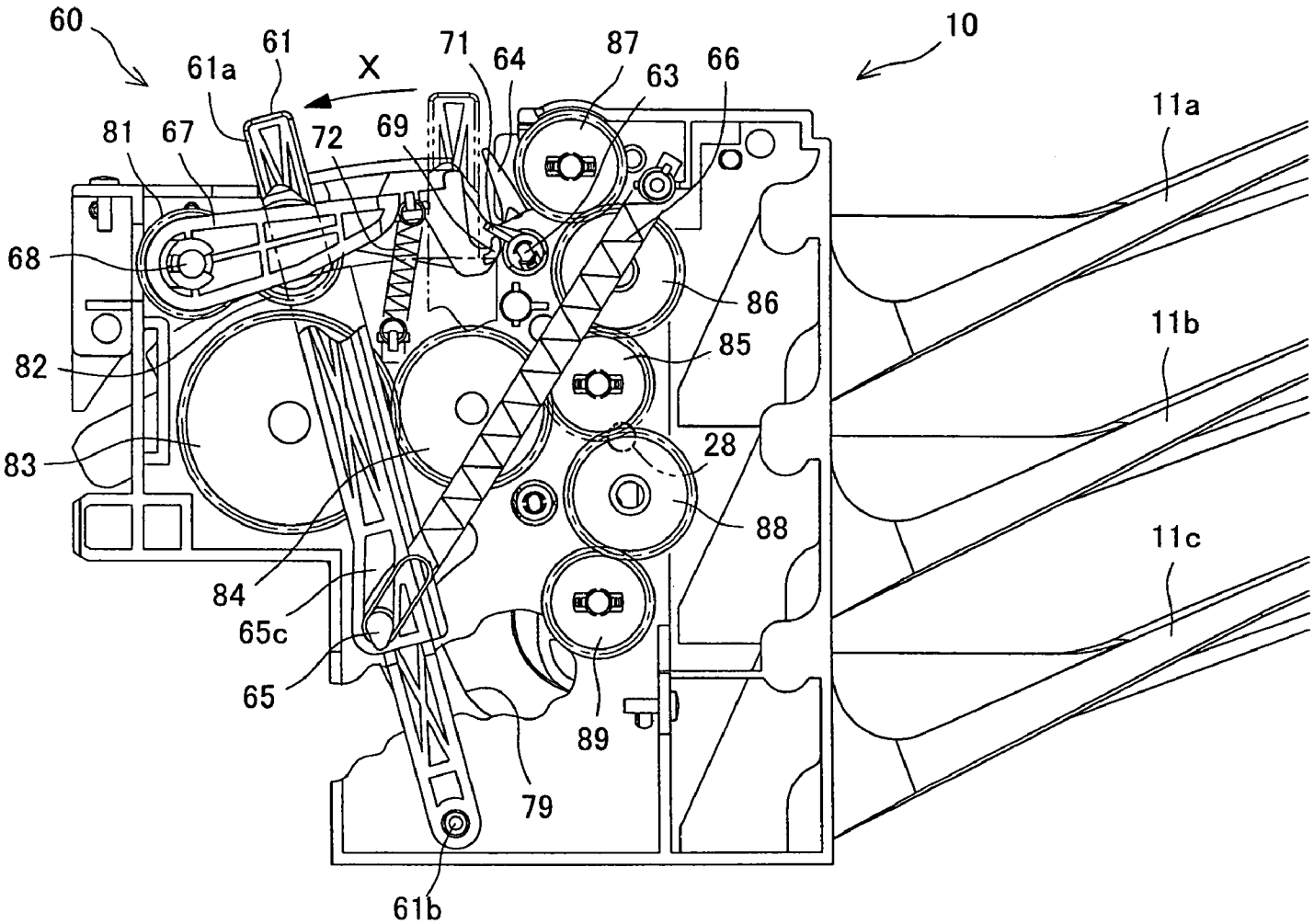
FIG. 5 is a partially cut-away, front view of the sheet stacking apparatus of the state shown in FIG. 3.

Therefore, an operator can operate the operating portion 61*a* of the jam release lever 61 to rotate the jam release lever 61 in the direction of the arrow X in FIG. 5. When doing so, the jam release lever 61 rotates around the shaft rotating pivot point 61*b*, which moves the protrusion 65 of the movable guide unit 62*b* to a predetermined position along the long hole

61*c* of the jam release lever 61. At the same time, the movable guide unit 62*b* is moved from a first position adjacent to the fixed guide unit 62*a* in a horizontal direction to a second position therebelow the fixed guide unit 62*a*. This overlaps the movable guide unit 62*b* and the fixed guide unit 62*a*. The vertical conveyance guide unit 73 (the inner guide surface 79) is separated from the opposing guide surface thereby opening the vertical conveyance path connecting to the trays 11*b* and 11*c* formed with the guide surface that opposes the vertical conveyance guide unit 73 (the inner guide surface 79).

Note that in FIG. 3, description of a portion of the fixed guide unit 62*a* is omitted to make it easier to understand that the movable guide unit 62*b* is positioned to overlap the fixed guide unit 62*a* therebelow. Also, the reference number 74 shown in FIG. 3 represents the flappers provided below the flappers 64 for switching a sheet discharge path between the middle-positioned tray 11*b* and the lowest-positioned tray 11*c*. The flappers 74 rotate in an upward direction around a rotating shaft, not shown, by the action of a solenoid and actuator, also not shown. The state where the flappers 74 are positioned in FIG. 3 is the initial state where the positions are controlled to lead a sheet to the middle level tray 11*b*. Through this configuration, when rotated in an upward direction, sheets are guided to the bottommost tray 11*c*.

A spring 66 is suspended at an end of the protrusion 65 to constantly urge the jam release lever 61 toward a direction opposite to the arrow X direction shown in FIG. 5. Therefore, when the operator releases his/her hand when the jam release lever 61 is moved in the direction of the arrow X of FIG. 5, the spring moves the jam release lever 61 back to its original position indicated by the broken lines in FIG. 5. Normally, when the jam release lever 61 is not being operated (when the jam release lever 61 is positioned at its initial position indicated by the broken lines in FIG. 5), the urging force of the spring 66 maintains the state in which the movable guide unit 62*b* is arranged in connection to the fixed guide unit 62*a*, and forms a horizontal path (see FIG. 2). The vertical conveyance guide unit 73 forms a vertical conveyance path in a vertical state having a gap separated slightly from the opposing guide surface. (See FIG. 4)

A link arm 67 is provided on the side of the jam release lever 61 to act as a linking member that rotatably supports predetermined gears that belong to a drive transmission unit that transmits drive force to convey sheets, having a plurality of connected gears, described in further detail below. When the jam release lever 61 is moved in the direction of the arrow X shown in FIG. 5, the link arm 67 engages a predetermined position of the jam release lever 61, and rotates while rising in an upward direction pivoting on a pivot point 68. The link arm 67 includes a claw portion 69 on one end. When the link arm 67 is rotated, the claw portion 69 engages an engaging piece 71 provided on the rotating shaft 63 of the flappers 64. As the engaging piece 71 is lifted, the rotating shaft 63 rotates to rotate the flappers 64 in an upward direction. Furthermore, a spring 72 is suspended on the link arm 67. This spring 72 urges the link arm 67 in a downward direction to move away from the engaging piece 71. For that reason, the jam release lever 61 moves in a direction of the arrow X shown in FIG. 5, while resisting the urging force of the springs 66 and 72.

Figure 6:
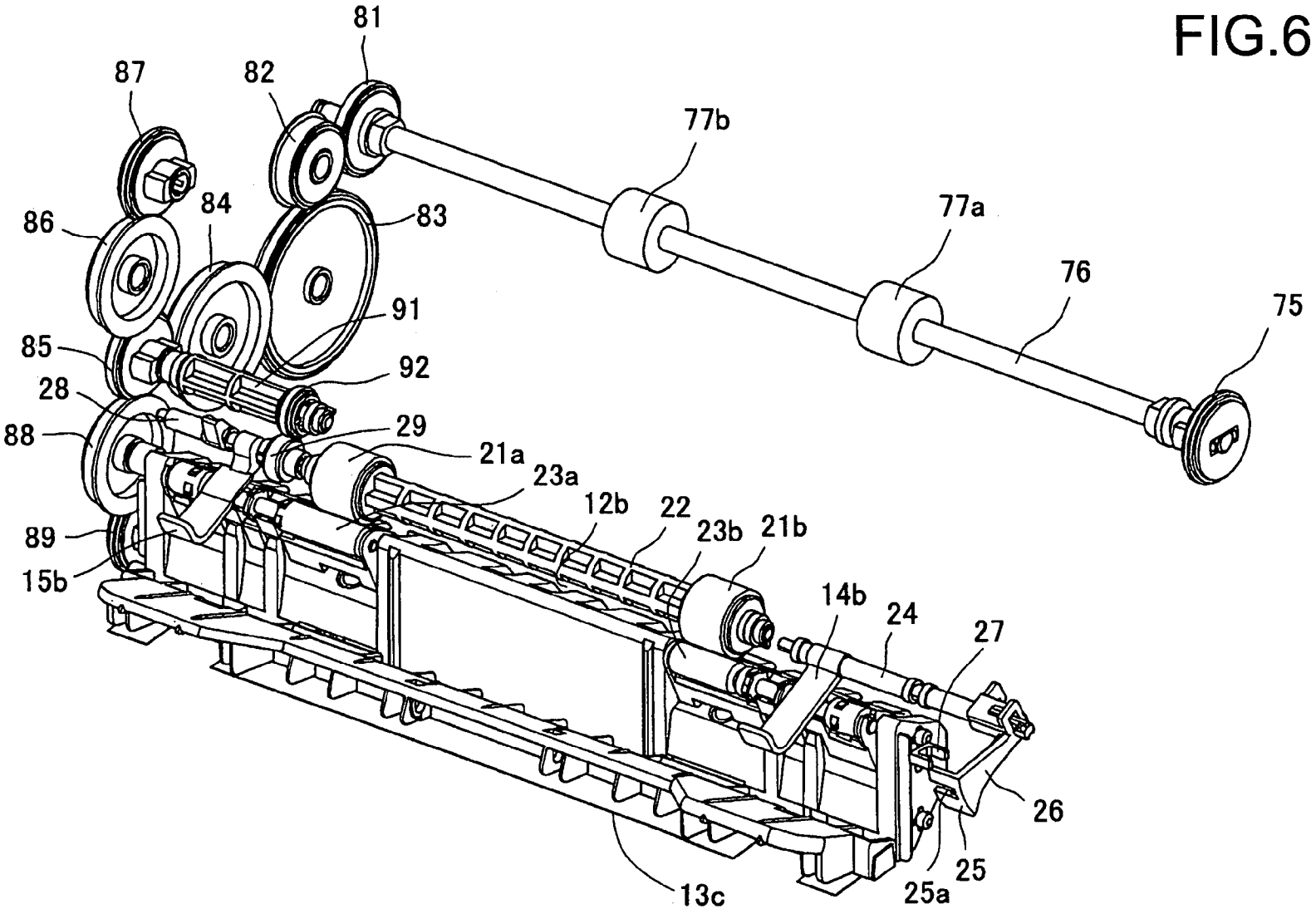
FIG. 6 is a perspective view showing an area near a sheet discharge outlet of the sheet stacking apparatus, and a drive transmission unit.

As can be clearly seen in FIG. 6, the sheet stacking apparatus 10 supplies drive force for conveyance and discharge of a sheet from the image forming apparatus 1. The sheet stacking apparatus 10 has a drive transmission mechanism as a drive transmission unit, for receiving drive force from the image forming apparatus 1.

The drive transmission mechanism has a gear 75 for receiving the transmission of drive force from the image forming apparatus 1. A rotating shaft 76 is equipped extending along a direction that intersects a sheet conveyance direction (in the sheet width direction). Inlet rollers 77*a* and 77*b*, described above, are fixed to this shaft 76. Also, a gear 81 is provided at a side opposing the gear 75 of the shaft 76. Drive force transmitted to the gear 81 via the shaft 76 is then transmitted to each of the connected gears 82, 83, 84, and 85.

Drive force from the gear 85 is transferred to the gear 86 provided on a top side of the gear 85 and to the gear 88 provided at a bottom side, and the drive force from the gear 86 is transmitted to the gear 87. From the gear 88, drive force is transmitted in the same way to the gear 89. A shaft 91 is provided to the gear 85 as a rotating shaft. A gear 92 is provided to a side opposing the gear 85 of this shaft 91. A gear 29 positioned therebelow meshes with the gear 92. The drive force transmitted to the gear 29 rotatingly drives the discharge rollers 21*a* and 21*b* as the sheet discharge unit that discharges sheets to the middle tray 11*b*.

FIG. 6 shows the configuration for discharging sheets to the tray 11*b* by transmitting drive force from the gear 85 to the gears 91, 92, 29 and the shaft 22, and finally transmitting drive force to drivingly rotate the discharge rollers 21*a* and 21*b* that discharge sheets to the middle tray 11*b* in the sheet discharge outlet 12*b*. The gears and shafts are also connected in the same way to the gear 87 and there is a configuration for transmitting the final drive force to the discharge rollers at the sheet discharge outlet 12*a*, for discharging sheets to the uppermost tray 11*a*. The gears and shafts are also connected in the same way to the gear 89, and there is a configuration for transmitting the final drive force to the discharge rollers at the sheet discharge outlet 12*c*, for discharging sheets to the lowermost tray 11*c*. Therefore, configurations that drivingly rotate in synchronization using the same structure are employed for each of the discharge rollers provided for the sheet discharge rollers 12*a*, 12*b*, and 12*c* that discharge sheets to the trays 11*a*, 11*b*, and 11*c*.

Figure 7:
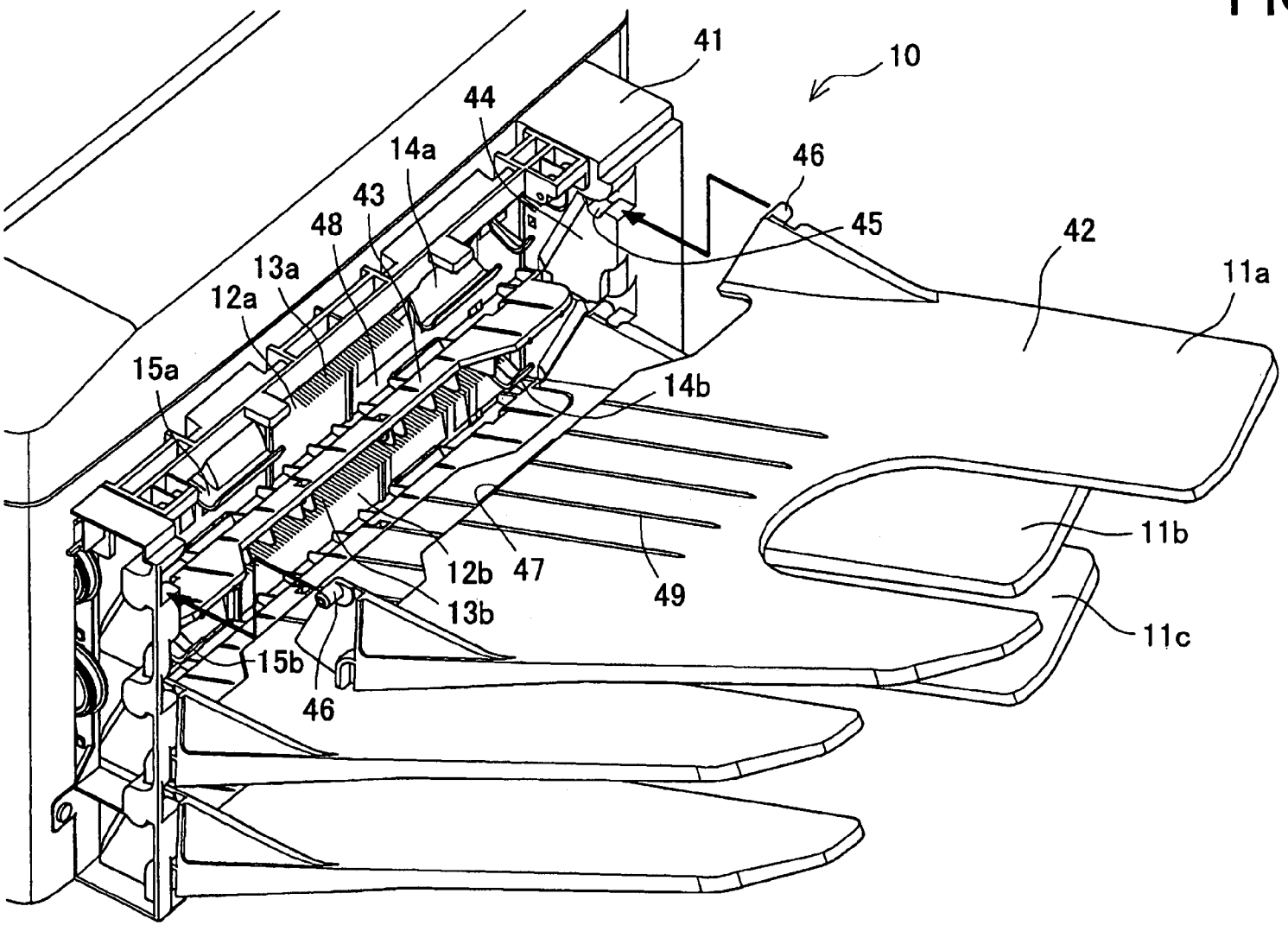
FIG. 7 is a perspective view near a tray of the sheet stacking apparatus showing a detachable member mounted to the main unit and linked with a fastening member.

As shown in FIG. 7, each of the discharge trays 11*a*, 11*b* and 11*c* is composed of a detachable member 42 detachably mounted to the main unit 41 of the sheet stacking apparatus 10 and a fastening member 43 fastened to an upright surface 48 of the main unit 41. The fastening member 43 is integrally formed to the upright surface 48 of the main unit 41 formed with sheet discharge outlets 12 (12*a*, 12*b*, and 12*c*), extending to both sides of the sheet stacking apparatus 10, and projecting outward from the image forming apparatus 1. The trays 11*a*, 11*b*, and 11*c* share the same structure. Therefore, an explanation will focus on the connecting structure of the uppermost tray 11*a*. Explanations of the tray 11*b* and 11*c* shall be omitted. Note that the upper and side portion coverings of the sheet stacking apparatus 10 have been omitted from the image of FIG. 7 to facilitate understanding of the internal structure of the sheet stacking apparatus 10.

Cylindrical hooks 46 projecting outward to the outer sides (the main unit 41 side) are formed at the upper corners of both side edges. Engaging holes 45 are formed in both side inner walls 44 on the main unit 41 to engage these hooks 46. By inserting the hooks 46 of the detachable member 42 to engage the engaging holes formed in the main unit 41, the separated detachable member 42 and fastening member 43 become connected, thereby configuring the tray 11*a*. At this time, the tray trailing edge support portion 47, at substantially the center of the detachable member 42, having a predetermined width positioned at the leading edge in the direction of insertion shown in FIG. 7, is positioned to touch the bottom surface of the opposing fastening member 43.

To detach the detachable member 42 from the main unit 41 and separate it from the fastening member 43, one lifts the end opposite to the tray trailing edge support member 47 of the detachable member 42 to free the tray trailing edge support member 47 from its contact with the bottom surface of the fastening member 43. Then, by pulling the detachable member 42 out and upward at an angle, the hooks 46 of the detachable member 42 can easily be detached from the engaging holes 45 formed in the main unit 41.

As can be seen in FIGS. 6 and 7, the sheet discharge outlets 12*a*, 12*b*, and 12*c*, and other members arranged in close proximity thereto share the same configuration as a rule. However, a movable lever member 14*a* and a weight member 15*a*, described in detail below, arranged in close proximity to the sheet discharge outlet 12*a* are wider extending in the center direction (the direction intersecting the sheet discharge direction) of the sheet discharge outlet 12*a* than the movable lever members 14*b* and 14*c* and the weight members 15*b* and 15*c* arranged in close proximity to the sheet discharge outlets 12*b* and 12*c*. Their shapes are different. The reason for this is to support special sheets that have a narrow width, such as envelopes or post cards discharged based on the center of the discharge outlet. For this reason, the following will explain the members near the sheet discharge outlets 12*b*. An explanation of the sheet discharge outlets 12*a*, and 12*c* will be omitted.

As shown in FIG. 6, a freely rotating, movable lever member 14*b* that functions as a detection lever in combination with a photo-interrupter 27, described below, is disposed near the sheet discharge outlet 12*b*. It touches the uppermost surface of a sheet as it is discharged to the tray 11*b*, and touches the uppermost surface of a sheet that is completely discharged and stacked in the tray 11*b*. The leading end of the movable lever member 14*b* is bent, and the movable lever member 14*b* is arranged in a position that intersects the sheet discharge direction. Specifically, it is positioned to be able to touch the portion near a corner of a sheet stacked on the discharge tray 11*b*, in the width direction of a discharged sheet.

The weight member 15*b* that pushes sheets discharged from the sheet discharge outlets 12*b* downward by touching their upper surfaces, is fastened to the shaft 28, and disposed as a pair to the movable lever member 14*b* on the opposite side (on the opposite side of the position of the movable lever member 14*b* in a direction intersecting the sheet discharge direction) thereof (the movable lever member and the weight member are a pair for the same sheet discharge outlet), sandwiching the sheet discharge outlet 12*b*. The weight member 15*b* is also rotatably disposed, like the movable lever member 14*b*. Note that in this embodiment, the movable lever members 14*b* and 14*c*, and the weight members 15*b* and 15*c*, share the same configuration.

In the same way as the movable lever member 14*b*, the weight member 15*b* has a freely rotating configuration to allow it to touch the uppermost surface of sheets as they are discharged and stacked in the tray 11*b*, and touch the uppermost surface of the sheets completely discharged and stacked in the tray 11*b*, and continue a rotating action simultaneous to the rotating action by the movable lever member 14*b* thereafter. The sheet pressing function of the weight member 15*b* improves the alignment of sheets stacked in the tray. Note that in the same way as the weight member 15*b*, the movable lever member 14*b* also has a function for pushing sheets being discharged in a downward direction.

The discharge rollers 21 (21*a* and 21*b*) described above are provided on both ends of the sheet discharge outlet 12*b* in the width direction of sheets discharged over the shaft 22. Discharge rollers 23 (23*a* and 23*b*) are opposingly arranged under each of the discharge rollers 21 to sandwich and discharge sheets. Note that by arranging the discharge rollers 23 in a sheet discharge direction side in the horizontal direction with regard to the discharge rollers 21, discharged sheets are discharged moving upward.

The movable lever member 14*b* is fixed to the shaft 24. The shaft 24 rotates freely as a rotating shaft. An arm 26 integrally formed with a douser plate 25 is fixed to the other end of the shaft 24. The movable lever member 14*b*, the arm 26 and the douser plate 25 integrally rotate. Also, along with the rotating action of the movable lever member 14*b* (as well as for the douser plate 25 and the arm 26), the douser plate 25 advances into and interrupts the light path of a photo-interrupter 27, provided with a light emitting element 27*a* and a light receiving element 27*b* (see FIG. 8), to detect the sheet being discharged and the stacked state of sheets stacked on the tray 11*b*.

Figure 8A:
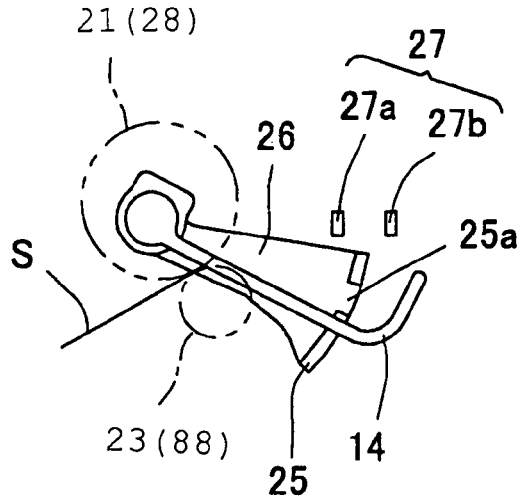

Specifically, according to this embodiment of the present invention, a slit 25*a* is formed in the douser plate 25. Each time a sheet is discharged, the sheet lifts the movable lever member 14*b* (and the weight member 15*b*) thereby causing the douser plate 25 to rotate and advance into the light path of the photo-interrupter 27 at the same time. The slit 25*a* of the douser plate 25 shifts from its initial transmissive state (a) (shown at FIG. 8A), to an interrupted state (b) (shown at FIG. 8B), the transmissive state (c) (shown at FIG. 8C), and then the interrupted state (d) (shown at FIG. 8D). During discharge of sheet S, the interrupted state of (d) (shown at FIG. 8D) is continued, but when sheet discharge is completed, the movable lever member 14*b* (as well as the weight member 15*b*) is freed from pressing sheets and falls, thereby rotating the douser plate 25 downward. The slit 25*a* of the douser plate 25 moves from the interrupting state (d) to the transmissive state (c) to the interrupting state (b), and to the transmissive state (a) again, to return to its original status, as shown in FIGS. 6 and 8A. Note that when the volume of sheets stacked on the tray 11*b* has reached a full state, in other words, the maximum amount that the tray can stack, the return motion (the motion of rotating downward) of the douser plate 25 stops at the interrupting state (b). A control mechanism, not shown, determines that the tray has reached its full, or maximum stacking amount.

Figure 8B:
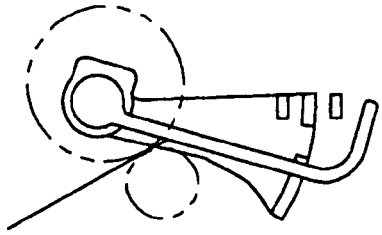
Figure 8C:
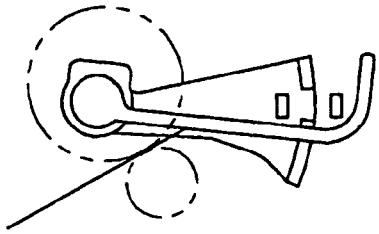
Figure 8D:
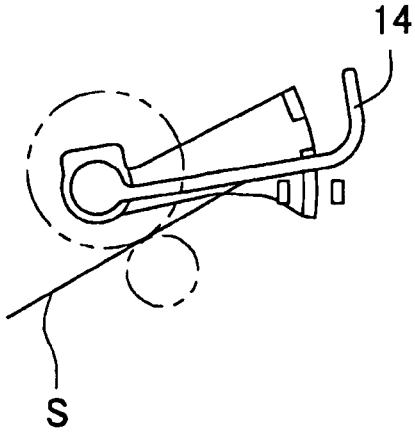

As described above, the movable lever member 14*b* touches a sheet S being output, for each sheet, and during a normal discharge, the status shifts from the initial one shown in FIG. 8A, to the state shown in FIG. 8B. Then, it shifts to the state shown in FIG. 8C, and finally to that shown in FIG. 8D. While the sheet is being discharged, the state of FIG. 8D is continued for a short amount of time, then when the sheet is completely discharged, the state changes from the one shown in FIG. 8D, to that of FIG. 8C. Continuing, the state changes to that shown in FIG. 8B and finally to that of FIG. 8A and the discharge operation of the sheet S is complete, but if the states do not shift to each step (specifically the states of FIG. 8A, FIG. 8B, FIG. 8C, and FIG. 8D) within a predetermined time period, or in other words, if the photo-interrupter 27 having the douser plate 25, the light emitting element 27*a* and the light receiving element 27*b* does not detect the pattern of shifting to the transmissive state and to the interrupted state, a control mechanism, not shown, determines that there has been a conveyance (discharge) problem of the sheet at the point (location) where the pattern was not detected.

Furthermore, as detection of sheet conveyance problems in the sheet stacking apparatus 10, not only is there the detection of conveyance (discharge) problems at the sheet discharge outlets, but after a protruding detection member, not shown, provided near the inlet rollers 77 (77*a* and 77*b*), detects a sheet, and the photo-interrupter 27 continues a transmissive state, without the movable lever member 14*b* shifting from the state shown in FIG. 8A to the state shown in FIG. 8B, even after a predetermined amount of time has passed, a control mechanism, not shown, determines that a sheet is experiencing a conveyance problem in the sheet conveyance path leading to the sheet discharge outlet, and is still inside the system (in a so-called paper jam).

Note that a gear 29 is disposed on one end of the drive shaft 22 as the rotating shaft of the discharge rollers 21. Drive from the gear 92 that meshes from above the gear 29 is transmitted to drivingly rotate the shaft 22, but the shaft 22 and shaft 28 are not connected.

As shown in FIG. 7, the fastening member 43 is disposed at a position to protect the movable lever member 14 and weight member 15. In other words, the fastening member 43 that configures the tray 11*a* protects the movable lever member 14*b* and weight member 15*b*. The fastening member 43 that configures the tray 11*b* protects the movable lever member 14*c* and weight member 15*c*. According to this embodiment of the present invention, the gap between the trays 11 is narrow at less than 40 mm. Because the trays 11 are disposed at an angle, it is difficult to look inside. This has been considered from a technical standpoint. Note that because there is no other tray above the tray 11*a*, it is easier to view inside the tray 11*a* area. Therefore, a simple plate-shaped member projecting from the upright surface of the main unit 41 protects the movable lever member 14*a* and weight member 15*a*.

As can be seen in FIGS. 6 and 7, static electricity discharge brushes 13 are provided at the bottom (the-under surface) of the fastening member 43 for removing static electricity charged to sheets, by touching the sheet being discharged from the sheet discharge outlets 12. They are mounted by tape along a width direction of a discharged sheet. As is clear from the drawings, the static electricity discharge brushes 13*b* are mounted to the bottom of the fastening member 43 that configures the tray 11*a*. The static electricity discharge brushes 13*c* are mounted to the bottom of the tray 11*b*. FIG. 6 schematically shows the static electricity discharge brushes 13*c*.

The following will explain the jam handling operations using the sheet conveyance problem release mechanism of the sheet stacking apparatus 10.

When it is known that a jam has been detected, such as by a sheet conveyance problem in the sheet stacking apparatus 10, the operator uses the operating unit 61 of the jam release lever 61 to rotate the jam release lever 61 in the direction of the arrow X shown in FIG. 5. This shifts the sheet stacking apparatus 10 from the state shown in FIGS. 2 and 4, to the state shown in FIGS. 3 and 5. This causes a predetermined portion of the jam release lever 61 to engage a portion of the link arm 67 as a link member thereby lifting the link arm 67 in an upward direction around the shaft pivot point 68. In this state, the claw portion 69 provided on an end of the link arm 67 engages the engaging piece 71 provided on the rotating shaft 63 of the flappers 64 pushing the engaging piece upward. This rotates the rotating shaft 64 causing the flappers 64 to rotate upward.

At the same time, along with the rotation of the jam release lever 61, the protrusion 65 penetrating the long hole 61*c* formed in the jam release lever 61 moves relative to between the long hold 61*c* and its restricting position is displaced. The movable guide unit 62*b* disposed on a side of the protrusion 65 rotates around a pivot point 78 in the same direction as the rotation in the direction of the arrow X in FIG. 5 of the jam release lever 61. Along with the movement of the movable guide unit 62*b* to a position that overlaps the fixed guide unit 62*a* thereunder, that is adjacent at an upstream side in the direction of sheet conveyance, the vertical conveyance guide unit 73 (inner guide surface 79), configuring a portion of the movable guide unit 62*b*, and connecting the horizontal conveyance path of the movable guide unit 62*b*, separates from the opposingly arranged guide surface thereby expanding the guide surface (the gap with the opposing surface) of the vertical conveyance path. The vertical conveyance guide unit 73 is then positioned obliquely.

Then, at the same time, along with the rotation of the jam release lever 61, the link arm 67 engages a predetermined position of the jam release lever 61 rotating to lift upward, so the gear 82 that pivots on the link arm 67 separates from the gear 83 opposingly arranged thereto, unmeshing (disconnecting) both. For that reason, the transmission of drive force from the image forming apparatus 1 is interrupted at a location positioned at an upstream side of the drive transmission path from the plurality of gears (for example gears 85, 86, 87, 88, and 89) that transmit drive force to the discharge rollers 21, in the drive transmission path composed of gear connections of the drive transmission mechanism having a plurality of gears as described above.

Therefore, by the rotating action of the jam release lever 61, (1) the flappers 64 rotate upward; (2) the movable guide unit 62*b* is positioned below the fixed guide unit 62*a*, while the vertical conveyance guide unit 73 is in an oblique state separated enough from the opposing guide surface; and (3) transmission of drive force supplied from the image forming apparatus 1 side is interrupted. Note that the flappers 74 described above maintain the oblique state (see FIG. 3) whose position is controlled to guide a sheet to the middle tray 11*b* when there is a sheet jam. The drive of the discharge roller 21 is free, so it is easy to remove the sheet if the sheet is discharged partway to the tray 11*b*.

The following will explain the action and effects of the sheet stacking apparatus 10 according to this embodiment of the present invention.

With the sheet stacking apparatus 10 of this embodiment of the present invention, the movable guide unit 62*b* rotates and moves to be overlappingly positioned under the adjacent fixed guide unit 62*a*, through the rotation of the jam release lever 61, and the vertical conveyance guide unit 73 moves to be inclined having sufficient separation from the opposingly arranged guide surface side. This configuration frees the inside of the device to free the sheet conveyance path to enable an operator to easily access the inside of the device from above to remove a jammed sheet, without requiring extra space or a configuration requiring excessive labor to remove jammed sheets.

Also, with the sheet stacking apparatus 10 according to this embodiment of the present invention, flappers 64 positioned at the highest position rotate in an upward direction to further improve accessibility of the inside of the device for handling jammed sheets. Furthermore, by dividing the drive transmission at an upstream side of the drive transmission path leading to the sheet discharge unit, the safety of handling jammed sheets is increased. Because the discharge rollers provided at a sheet discharge outlet do not receive any drive, they can rotate in both the forward and reverse directions freely, thus it is easier to handle the sheet that caused the jam by pulling it either from the inside of the freed device or from the tray side of the sheet discharge outlet. Moreover, with the configuration described above, there is no need for a configuration that provides extra space or excessive work to remove jammed sheets. The operator only needs to rotate the jam release lever 61 when a sheet jam has occurred, and a plurality of actions occur simultaneously relating to the handling of a jammed sheet. Then, after handling the jammed sheet, the operator only needs to release the jam release lever 61, and all of the related mechanisms will return to their original statuses. This improves operability when a jam has occurred and simplifies the work relating to the handling of a jammed sheet.

Note that the embodiment of the present invention describes an example as applied to a multi-function device on the image forming apparatus 1. However, the invention is not limited to this example, and can be properly applied to a device that outputs sheets formed thereupon with images and characters. Furthermore, this embodiment of the present invention provides an example of forming (mounting) the guide surface that opposes the horizontal conveyance guide unit 62 on the upper cover 6, but this invention is not limited to that. It is also acceptable to form a guide surface that opposes the sheet stacking apparatus 10 side.

Still further, this embodiment of the present invention provides an example of integrally forming the vertical conveyance guide unit 73 with the movable guide unit 62*b* to constantly be positioned substantially vertically. However, the invention is not limited to this configuration. It is also acceptable to configure this to be a unit separate from the movable guide unit 62*b*. This embodiment of the present invention provides an example of moving the movable guide unit 62*b* to a second position below the fixed guide unit 62*a*. If instead, the movable guide unit 62*b* is moved to a position overlapping the fixed guide unit 62*a*, an operator can access the device from above, so it is also acceptable to move the movable guide unit 62*b* to above the fixed guide unit 62*a*.

The present application claims the right of priority based on Japanese Patent Application No. 2005-129168 filed Apr. 27, 2005, and the Japanese application is incorporated by reference herein.

What is claimed is:

1. A sheet conveyance release mechanism, comprising:

a horizontal conveyance guide unit having a movable guide unit, and a fixed guide unit disposed adjacent to the movable guide unit, for conveying a sheet in a substantially horizontal direction;

a vertical conveyance guide unit for conveying the sheet in a substantially vertical direction;

a conveyance guide movement unit for moving the movable guide unit from a first position adjacent to the fixed guide unit in a horizontal direction, to a second position either under or over the fixed guide unit to overlap with the fixed guide unit, and separating the vertical conveyance guide unit from a guide surface facing the vertical conveyance guide unit, a flapper for switching a conveyance path of the sheet conveyed between the horizontal conveyance guide unit and the vertical conveyance guide unit, and a link member for rotating the flapper in an upward direction, wherein the link member includes a predetermined gear and is pivotally supported such that said predetermined gear is capable of separating from an opposingly arranged and meshed gear of a plurality of gears for transmitting drive force to convey the sheet.

2. The sheet conveyance release mechanism according to claim 1, wherein the predetermined gear is a part of a drive transmission path leading to a sheet discharge unit for discharging the sheet from an apparatus, and is disposed at an upstream side of the drive transmission path from a gear that directly applies drive force to the sheet discharge unit so that the predetermined gear is arranged to separate from the drive transmission path via the link member to interrupt drive transmission thereafter at an upstream side of the drive transmission path.

3. The sheet conveyance release mechanism according to claim 1, wherein the conveyance guide movement unit has a rotatable lever member connected to one of the movable guide unit and the vertical conveyance guide unit, and the flapper has a rotating shaft, the lever member rotates the movable guide unit to below the fixed guide unit such that the vertical conveyance guide unit is positioned in an oblique orientation, a portion of the lever member engages the link member thereby moving the link member and separating the predetermined gear from the opposingly arranged gear to interrupt drive transmission, and the link member rotates the flapper rotating shaft to rotate the flapper in an upward direction.

4. The sheet stacking apparatus comprising:

at least one discharge tray for stacking a sheet discharged from a sheet discharge outlet;

a horizontal conveyance guide having a movable guide unit, and a fixed guide unit disposed adjacent to the movable guide unit, formed in a sheet conveyance path, for conveying the sheet in a substantially horizontal direction;

a vertical conveyance guide unit for conveying the sheet in a substantially vertical direction;

a flapper for switching the sheet conveyance path conveyed between the horizontal conveyance path and the vertical conveyance path, the flapper having a rotating shaft and being capable of rotating around the rotating shaft;

a conveyance guide movement unit for moving the movable guide unit from a first position adjacent to the fixed guide unit in a horizontal direction, to a second position under the fixed guide unit to overlap with the fixed guide unit, and separating the vertical conveyance guide unit from a guide surface facing the vertical conveyance guide unit;

a link member for rotating the flapper rotating shaft so as to rotate the flapper in an upward direction; and a drive transmission unit having a plurality of gears for transmitting drive force for conveying and discharging the sheet to the discharge tray, wherein the link member pivotably supports a predetermined gear capable of separating from an opposingly arranged and meshed gear of the plurality of gears.

5. The sheet stacking apparatus according to claim 4, wherein a plurality of discharge trays is arranged in the vertical orientation.

6. The sheet stacking apparatus according to claim 4, wherein the movable guide unit and the vertical conveyance guide unit are structurally integral and provide the guide surface for conveying a sheet.

7. A sheet stacking apparatus according to claim 4, further comprising a discharge roller disposed at the sheet discharge outlet for discharging the sheet to the discharge tray, wherein the drive transmission unit transmits the drive force to the discharge roller, and the predetermined gear is disposed at an upstream side of the drive transmission unit from a gear that directly applies the drive force to the discharge roller so that the predetermined gear is arranged to separate from a drive transmission path via the link member to interrupt the drive transmission thereafter at an upstream side of the drive transmission unit.

8. The sheet stacking apparatus according to claim 4, wherein the conveyance guide movement unit has a rotatable lever member connected to one of the movable guide unit and the vertical conveyance guide unit, and the flapper has a rotating shaft, the lever member rotates the movable guide unit to below the fixed guide unit such that the vertical conveyance guide unit is positioned in an oblique orientation, a portion of the lever member engages the link member thereby moving the link member and separating the predetermined gear from the opposingly arranged gear to interrupt drive transmission, and the link member rotates the flapper rotating shaft to rotate the flapper in an upward direction.

* * * * *